US005652953A

United States Patent [19]

Imai

[11] Patent Number: 5,652,953

[45] Date of Patent: Jul. 29, 1997

[54] METHOD AND APPARATUS FOR CONTROLLING DISCHARGE POTENTIALS AND TIMING IN A REVERSAL DEVELOPMENT TYPE IMAGE FORMING APPARATUS

[75] Inventor: Masaaki Imai, Kasugai, Japan

[73] Assignee: Brother Kogyo Kabushiki Kaisha, Nagoya, Japan

[21] Appl. No.: 495,077

[22] Filed: Jun. 27, 1995

[30] Foreign Application Priority Data

Jul. 21, 1994 [JP] Japan ..... 6-191161

[51] Int. Cl.[6] ..... G03G 21/00

[52] U.S. Cl. ..... 399/98; 347/129; 347/140

[58] Field of Search ..... 355/208, 219, 355/216, 246; 347/252, 253, 129, 132, 140, 247, 237; 399/53, 98, 128, 129

[56] References Cited

U.S. PATENT DOCUMENTS

| | | | |
|---|---|---|---|
| 4,984,022 | 1/1991 | Matsushita et al. | 355/246 |
| 5,003,353 | 3/1991 | Nitta | 355/265 |
| 5,179,411 | 1/1993 | Yoshiuchi et al. | 355/208 |
| 5,459,555 | 10/1995 | Yamasa et al. | 355/208 |

FOREIGN PATENT DOCUMENTS

| | | |
|---|---|---|
| 0 344 930 A1 | 12/1989 | European Pat. Off. . |
| 0 475 334 A3 | 3/1992 | European Pat. Off. . |
| 55-45059 | 3/1980 | Japan . |
| 59-104675 | 6/1984 | Japan . |

*Primary Examiner*—Shuk Lee

*Attorney, Agent, or Firm*—Oliff & Berridge

[57] ABSTRACT

An image forming apparatus is capable of preventing carriers and toner particles from migrating from a developing sleeve to a photosensitive drum when the apparatus is stopped. When the image forming operation is stopped, laser beam emission by a laser source initially starts with an output reduced and/or the power supply to the developing sleeve is intermittently cut off. In that portion of the photosensitive drum receiving the reduced output laser beam, the potential charge of the surface is reduced. When the leading part of the laser beam-irradiated surface of the photosensitive drum which has been exposed to the full power laser beam reaches the developing sleeve, a switch circuit for the developing sleeve is permanently turned off. With the photosensitive drum potential lowered in advance and/or the potential of the developing sleeve gradually lowered, the potential difference between the developing sleeve and the photosensitive drum is minimized, regardless of minor timing errors upon deactivation of the sleeve potential.

20 Claims, 9 Drawing Sheets

METHOD AND APPARATUS FOR CONTROLLING DISCHARGE POTENTIALS AND TIMING IN A REVERSAL DEVELOPMENT TYPE IMAGE FORMING APPARATUS

BACKGROUND OF THE INVENTION

1. Field of the Invention

This invention is directed to an image forming apparatus for use in copiers, printers and the like. More particularly, this invention is directed to a reversal development method type image forming apparatus.

2. Description of the Related Art

Traditionally, most image forming apparatus used in printers, copiers, facsimile machines and the like operate use the reverse development method. A typical photosensitive drum used in conjunction with the reversal development method is shown in FIGS. 11 and 12. FIG. 11 graphically represents the electrostatic potentials used in the reversal development method where a photosensitive drum potential Vo is placed on a photosensitive drum 141 and a developing sleeve potential Vb is placed on a developing sleeve 146.

FIG. 12 is a schematic view of the conventional photosensitive drum 141. A charger 144 charges the photosensitive drum 141 uniformly to 700 V. A power supply (not shown) charges the developing sleeve 146 to 550 V. Negatively charged carriers 154 and positively charged toner particles 152 attached to the carriers 154 are electrostatically attracted to the developing sleeve 146. The carriers 154 and the toner particles 152 rotate together with the developing sleeve 146. To print, a laser beam 150 is focused or directed onto the photosensitive drum 141 to selectively lower the previously charged 700 V potential down to a discharged 150 V potential. That is, the original 700 V potential is removed or discharged.

When the discharged portions of the drum 141 come into contact with the developing sleeve 146, the toner particles 152, which are attached to the carriers 154 attached to the developing sleeve 146, migrate to the discharged portions of the photosensitive drum 141 due to the 400 V potential difference between the drum 141 and the developing sleeve 146. That is, the discharged portion of the photosensitive drum 141 have a potential of 150 V, while the developing sleeve 146 has a potential of 550 V. To print the output image, the toner particles 152 attached to the photosensitive drum 141 are transferred onto recording paper (not shown) by a transfer roller 142.

When this conventional image forming apparatus is deactivated, a light beam from either an erase lamp (not shown) or the laser beam 150 is focused or directed onto the photosensitive drum 141 while the drum 141 is rotated, so that the drum surface potential is lowered or discharged to 150 V. The photosensitive drum 141 is rotated until the discharged portions come into contact with the developing sleeve 146. The potential applied to the developing sleeve 146 is then removed.

One disadvantage of the reversal development method, as outlined above, is its tendency to permit some of the toner particles 152 or the carriers 154 to migrate from the developing sleeve 146 to the photosensitive drum 141 when the image forming apparatus is stopped. FIG. 13 graphically represents the photosensitive drum potential Vo and developing sleeve potential Vb in effect when a typical conventional image forming apparatus is deactivated.

As illustrated, when the laser beam 150 is focused or directed onto the photosensitive drum 141, the potential Vo at point D, where the laser beam originally strikes the photosensitive drum 141, is immediately lowered to 150 V. On the other hand, when the power is removed from the developing sleeve 146, the potential on the developing sleeve 146 is rapidly reduced, as indicated by curve c, but not as rapidly as is the potential Vo from the photosensitive drum 141. This occurs because the developing sleeve 146 is equipped with a capacitor (not shown), which is used to prevent sparks. In such a setup, a large potential difference momentarily develops between the photosensitive drum 141 and the developing sleeve 146.

In particular, the large momentary potential difference occurs due to manufacturing errors that vary the distance between the laser beam-irradiated position D on the photosensitive drum 141 and the contact position, point E, between the photosensitive drum 141 and the developing sleeve 146. Hence, the time required for the point D, which has been irradiated with the laser beam, to reach the contact position, point E, between the photosensitive drum 141 and the developing sleeve 146 as the photosensitive drum 141 is rotated, is highly variable or unstable.

Thus, when the potential on the developing sleeve 146 is removed, based on a preferred time the laser beam-irradiated point D takes to reach the contact position, point E, deactivation of the developing sleeve potential Vb may occur before or after the laser beam-irradiated point D has arrived at point E. That is, the deactivation timing can be advanced or delayed relative to the correct timing. Thus, a timing mismatch can occur.

The deactivation of the developing sleeve potential Vb may be delayed beyond the laser beam-irradiated point D, as shown by curve b in FIG. 13. In this case, the potential Vo of the photosensitive drum 141 drops to 150 V at point D in FIG. 13, whereas the potential Vb of the developing sleeve 146 remains close to 550 V. This causes the positively charged toner particles 152 to stick to the photosensitive drum 146. With the toner particles 152 attached to the photosensitive drum 141 when the drum 141 is stopped, the toner particles 152 migrate to the transfer roller 142. When the next print operation is started, the toner particles 152 which migrated to the transfer roller 142 are transferred onto the back of the recording paper.

Conversely, the deactivation of the developing sleeve potential Vb may occur before the laser beam-irradiated point D arrives, as shown by curve a in FIG. 13. In this case, the potential Vo of the photosensitive drum 141 remains at 700 V, whereas the potential Vb of the developing sleeve 146 drops close to 150 V, as illustratively at point D in FIG. 13. This causes the negatively charged carriers 154 to stick to the photosensitive drum 141. Additionally, if oppositely charged toner particles 152 exist, in this case negatively charged toner particles 152, the oppositely charged toner particles 152 will also stick to the photosensitive drum 141 along with the carriers 154. In the following description, for illustrative purposes, only the carriers 154 are referred to. With the carriers 154 stuck to the photosensitive drum 141, these carriers 154 come between the transfer roller 142 and the photosensitive drum 141, as well as between a cleaning blade (not shown) and the photosensitive drum 141. The carriers 154, which are made of hard ferrite particles and the like, can damage the photosensitive drum 141, whose soft surface is, for example, formed by an organic photosensitive material.

SUMMARY OF THE INVENTION

This invention overcomes the above outlined and other deficiencies and disadvantages of the prior art, by providing an image forming apparatus capable of preventing the carrier and toner from migrating from the developing sleeve to the photosensitive drum when the apparatus is stopped.

In a first preferred embodiment of this invention, an image forming apparatus comprises a photosensitive drum, a charger for electrically charging a surface of the photosensitive drum a laser unit for emitting a laser beam to remove charges from the surface of the photosensitive drum to form a latent image on the photosensitive drum, a developing sleeve for developing the latent image on the photosensitive drum, a developing sleeve power supply for charging the developing sleeve, and a control unit for controlling the laser unit and the developing sleeve power supply. When this image forming apparatus is stopped, the control unit controls the laser unit to initially emit a reduced output laser beam and, after a predetermined time, to emit a full output laser beam for total exposure of the photosensitive drum surface to the laser beam in order to start removing the surface charge. The developing sleeve power supply is deactivated when a leading portion of the photosensitive drum, to which the full output laser beam was directed, reaches the developing sleeve.

In a second preferred embodiment of this invention, the image forming apparatus comprises the photosensitive drum, the charger for electrically charging the surface of the photosensitive drum, the laser unit for emitting the laser beam to remove charges from the surface of the photosensitive drum, the developing sleeve, the developing sleeve power supply for charging the developing sleeve, and the control unit for controlling the laser unit and the developing sleeve power supply. When this image forming apparatus is stopped, the control unit controls the laser unit to fully expose the surface of the photosensitive drum with the laser beam in order to start removing the surface charges. The developing sleeve power supply is intermittently deactivated once the leading portion of the photosensitive drum, from which the surface charge was removed by the laser beam, reaches the developing sleeve, and, after a predetermined time, the developing sleeve power supply is permanently deactivated.

In a third preferred embodiment of this invention, when the image forming apparatus is stopped, the control unit controls the laser unit to initially emit a reduced output laser beam and, after a first predetermined time, to emit a full output laser beam for total exposure of the photosensitive drum surface to the laser emission in order to start removing the surface charges. The developing sleeve power supply is intermittently deactivated once the leading portion of the photosensitive drum, from which the surface charge was removed by the laser beam, reaches the developing sleeve and, after a second predetermined time, the developing sleeve power supply is permanently deactivated.

When the image forming apparatus of the first preferred embodiment of the invention is stopped, the intensity of the laser beam output by the laser unit is reduced when the laser beam is initially emitted. In that portion of the photosensitive drum which receives the reduced output laser beam, the surface charge potential is merely lowered. After a predetermined time, the laser unit is controlled to output a full intensity laser beam to totally expose the photosensitive drum surface to the laser beam, thereby fully removing the drum surface charge. When the laser beam-irradiated leading portion of the photosensitive drum, i.e., the drum surface part where the potential of the surface charges is merely lowered, reaches the developing sleeve, the developing sleeve power supply is switched off. Because the potential on the photosensitive drum is lowered in advance, the potential difference between the developing sleeve and the photosensitive drum is minimized, regardless of the minor timing error that can occur when the developing sleeve power supply is deactivated. This prevents the toner particles or the carriers from being attracted onto the photosensitive drum when the apparatus is stopped.

When the image forming apparatus of the second preferred embodiment of this invention is stopped, the laser unit fully exposes the photosensitive drum surface to the laser beam to remove the surface charge. When that leading portion of the photosensitive drum surface from which the surface charge was removed by the laser beam reaches the developing sleeve, the developing sleeve power supply is intermittently deactivated. That is, the potential of the developing sleeve is gradually lowered. Because the developing sleeve potential is gradually reduced, the potential difference between the developing sleeve and the photosensitive drum is minimized, regardless of any minor timing error that occurs when the developing sleeve power supply is deactivated. This also prevents the toner particles or the carriers from being attracted to the photosensitive drum when the apparatus is stopped.

When the image forming apparatus of the third preferred embodiment of this invention is stopped, the intensity of the laser beam output by the laser unit is reduced when the laser beam is initially emitted. In the portion of the photosensitive drum which receives the reduced output laser beam, the surface charge potential is merely lowered. After the first predetermined time, the laser unit is controlled to output an intensity full laser beam to totally expose the photosensitive drum surface to the laser beam, thereby fully removing the drum surface charge. When the laser beam-irradiated leading portion of the photosensitive drum, i.e., the drum surface part where the potential of the surface charges is merely lowered, reaches the developing sleeve, the developing sleeve power supply is intermittently turned off. That is, the potential of the developing sleeve is gradually lowered. With the developing sleeve potential gradually reduced and with the photosensitive drum potential lowered in advance, the potential difference between the developing sleeve and the photosensitive drum is minimized, regardless of any minor timing error that occurs when the developing sleeve power supply is deactivated. This also prevents the toner particles or the carriers from being attracted to the photosensitive drum when the apparatus is stopped.

As described above, the image forming apparatus of this invention minimizes, during a stop period, the potential difference between the photosensitive drum and the developing sleeve regardless of minor manufacturing errors. This prevents the toner particles or carriers from sticking to the photosensitive drum. Accordingly, the back of the recording paper is kept free of toner stains and the photosensitive drum is protected against damage from stuck carriers.

BRIEF DESCRIPTION OF THE DRAWINGS

The preferred embodiments of this invention will be described in detail with reference to the following drawings, wherein.

DETAILED DESCRIPTION OF THE PREFERRED EMBODIMENTS

Figure 1:
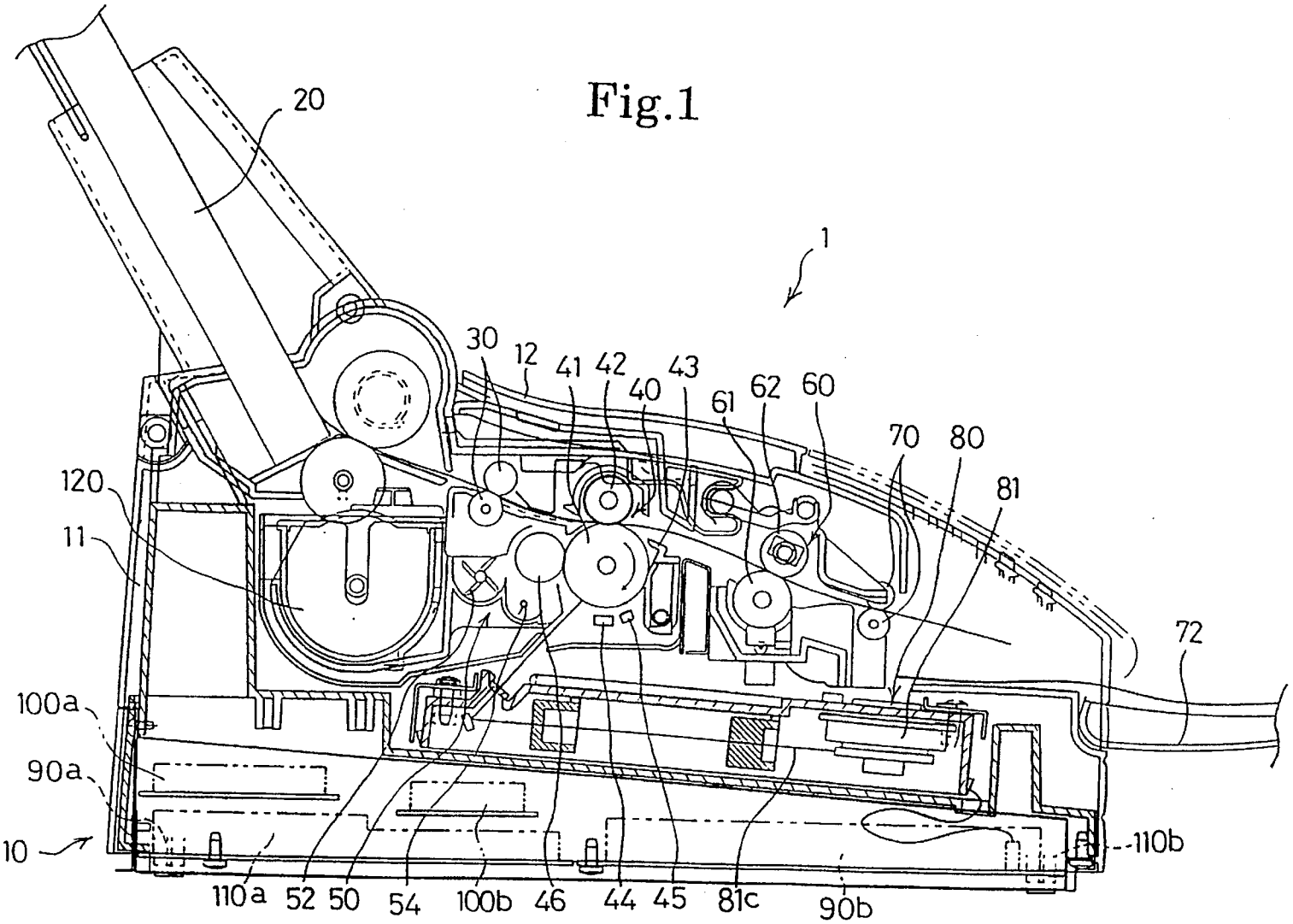
FIG. 1 is a schematic cross-sectional view of a printer comprising an image forming apparatus of the preferred embodiments of this invention.

As shown in FIG. 1, a image forming apparatus or printer 1 comprises a casing 10. A sheet feed cassette 20 is removably mounted in the top left portion of the casing 10. Print sheets stacked inside the sheet feed cassette 20 are taken one at a time, are forwarded via a pair of transport rollers 30, and moved between a photosensitive drum 41 and a transfer roller 42. The photosensitive drum 41 and transfer roller 42 form a photosensitive material unit 40. A cleaning blade 43, an erase lamp 45 and a charger 44 are positioned around the photosensitive drum 41. The cleaning blade 43 removes residual toner from the surface of the photosensitive drum 41 and collects the removed residual toner into a developing unit 50. The erase lamp 45 emits light onto the surface of the photosensitive drum 41 to erase any remaining residual charge from the surface of the photosensitive drum 41. The charger 44 charges the surface of the photosensitive drum 41 to 700 V in a substantially uniform manner.

The developing unit 50 is located adjacent to the photosensitive material unit 40 and closer to the sheet feed cassette 20. The developing unit 50 has a toner agitator 52 for agitating the toner particles and a carrier agitator 54 for agitating both the toner particles and the carriers. A fusing unit 60, comprising a heating roller 61 and a pressing roller 62, a pair of sheet ejection rollers 70, and an ejected sheet tray 72 are positioned on the side of the developing unit 50 opposite to the photosensitive material unit 40. Under the sheet feed cassette 20, the photosensitive material unit 40, and the fusing unit 60 is a scanner unit 80 mounted on a frame 11 placed inside the casing 10. Under the frame 11 and at the bottom of the casing 10 are control boards 90*a* and 90*b*, an optional interface 100*a*, an optional RAM 100*b*, and two power supply units 110*a* and 110*b*. A cover 12, which pivotably encloses the casing 10, is positioned above the photosensitive material unit 40 and fusing unit 60. A plurality of keys (not shown) for operation purposes are positioned on top of the apparatus body 10 near the cover 12.

In the printer 1, a laser scanner 81 in the scanner unit 80 emits a laser beam, which is focused or directed onto the surface of the photosensitive drum 41. The laser beam is modulated based on image data transmitted from an external device. The charger 44 charges the surface of the photosensitive drum 41 to 700 V prior to scanning. The laser beam focused onto the surface of the photosensitive drum 41 removes the surface potential (i.e. lowers the surface potential to 150 V) when modulated at full intensity. The laser beam is modulated to form an electrostatic latent image on the surface of the photosensitive drum 41.

In the agitation chamber enclosing the carrier agitator 54 of the developing unit 50, powdery magnetic toner particles fed from a toner cartridge 120 are mixed with the negatively charged carriers retained in the agitation chamber. The mixture is agitated to positively charge the toner particles. After agitation, the toner particles and the carriers are drawn to the surface of the developing sleeve 46 by a magnet roller (not shown) positioned inside the developing sleeve 46. From the developing sleeve 46, the toner particles are selectively supplied to the photosensitive drum 41. This is the magnetic brush development method which develops the latent image formed on the photosensitive drum 41.

Thereafter, a voltage is applied to the transfer roller 42 to transfer the developed image onto the print sheet fed between the photosensitive drum 41 and the transfer roller 42. Once the image is transferred to the print sheet, the fusing unit 60 applies heat and pressure to the print sheet to fix the image on the print sheet. The print sheet, with the image fixed on it, is then ejected into the ejected sheet tray 72 through the pair of sheet ejection rollers 70.

Figure 2:
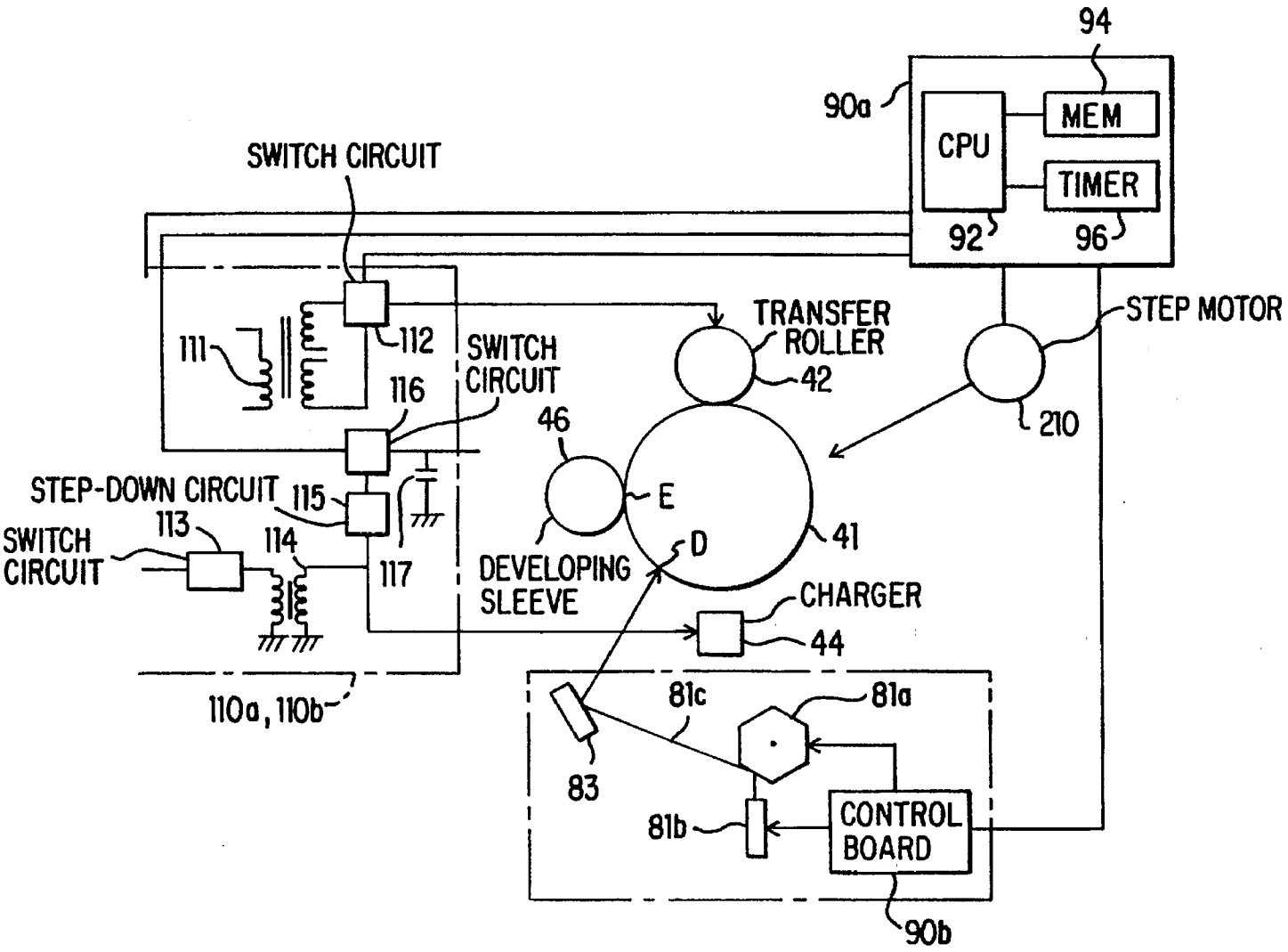
FIG. 2 is a block diagram of the control mechanisms of the image forming apparatus of FIG. 1.

FIG. 2 schematically shows the mechanisms of the photosensitive drum 41 and its control unit. The control board 90*a* comprises a CPU 92, a memory MEM 94 and a timer 96. In operation, the control board 90*a* supplies control signals to a step motor 210 for rotating the photosensitive drum 41. The control board 90*a* also supplies control signals to the power supply units 110*a* and 110*b* for controlling the potential applied to the charger 44 and other component parts. The control board 90*a* also supplies control signals to the control board 90*b* for controlling the laser scanner 81.

The power supply units 110*a* and 110*b* include a transformer 111 having a switch circuit 112 and a transformer 114 having a switch circuit 113. The transformer 111 applies a high voltage to the transfer roller 42 through the switch 112. The transformer 114 feeds a high voltage to the charger 44 and is controlled by the switch 113. The output of the transformer 114 is also connected by another switch circuit 116. The switch circuit 116 turns on and off the voltage to the developing sleeve 46 via a step-down circuit 115. The output of the switch circuit 116 is connected to ground through a capacitor 117. The switch circuit 112 for the transfer roller 42 is controlled to supply a forward-direction potential at a toner transfer time, by which the positively charged toner is attracted to the transfer roller 42, and to supply a reverse-direction potential to the transfer roller 42 at non-toner transfer times.

The control board 90*b* controls a laser source 81*b* of the laser scanner 81 to emit a laser beam 81*c*, and controllably rotates a polygon scanner 81*a* of the laser scanner 81 at a predetermined speed to horizontally scan the photosensitive drum 41 with the laser beam 81*c* output from the laser source 81*b*. The laser beam 81*c* reflected by the polygon scanner 81*a* is further reflected by a mirror 83 to direct the laser beam 81*c* onto the photosensitive drum 41. The reflected laser beam reaches the photosensitive drum 41 and erases the charged surface potential of 700 V to 150 V.

FIGS. 3(A) through 3(D) are timing charts of typical timings for potentials applied in different operations. FIG. 4 is a graphical representation of the applied potentials. FIGS. 5(A) through 5(D) are waveform charts showing typical modulated inputs to the laser source 81*b*.

Before the image forming apparatus 1 is stopped, the switch circuit 113 of the power supply units 110*a* and 110*b* remains on. The surface of the photosensitive drum 41 is charged prior to time t1 to 700 V by the charger 44, as shown in FIG. 3(A). When the switch circuit 116 is on, the 700 V potential, which is lowered to 550 V by the step-down circuit 115, is applied prior to time t2' to the developing sleeve 46, as shown in FIG. 3(C). Furthermore, the switch circuit 112 supplies the transfer roller 42 with a potential whose polarity is opposite to that used at non-toner transfer time, as shown in FIG. 3(D).

At a time t1, which is when postprocessing is initiated, a control signal from the control board 90*a* controls the control board 90*b* to control the laser source 81*b* to start emitting the laser beam 81*c*, as shown in FIG. 3(B). At this point, the control board 90*b* supplies the laser source 81*b* with a pulse modulation signal having a 50% duty ratio as a rapid modulation signal, as shown in FIG. 5(B). On that portion of the surface of the photosensitive drum 41 which is irradiated by the laser beam 81*c*, the surface potential Vo is lowered to about 425 V, as indicated by point D of FIG. 4. The control board 90*b* controls the laser source 81*a* to continue emitting the laser beam 81*c* up to a time t1' based on the pulse modulation signal. From the time t1', the control board 90*b* supplies the laser source 81*b* with the pulse modulation signal having a 100% duty ratio, as shown in FIG. 5(A). This results in a continuous unmodulated laser beam 81*c*. On that portion of the surface of the photosensitive drum 41 which is irradiated by the laser beam 81*c*, the surface potential of the photosensitive drum 41 is lowered to about 150 V, as indicated by point F in FIG. 4.

In the meantime, the control board 90*a* continues to rotate the photosensitive drum 41 by controlling the step motor 210 in accordance with a clock signal generated by the timer 96. The control board 90*a* turns off the switch circuit 116 to reduce the potential of the developing sleeve 46 down to a ground level at a time t2 based on the clock signal from the timer 96. More precisely, switch 116 is turned off immediately after the time t2. The time t2 corresponds to the time when the point of the photosensitive drum 41, as indicated by point D in FIG. 2, which was irradiated by the laser beam 81*c* at the time t1, reaches the developing sleeve 46, as indicated by point E. The potential of the developing sleeve 46 drops fairly rapidly, as indicated by curve c in FIG. 4, but not as rapidly as the potential of the photosensitive drum, due to the capacitor 117. It should be noted that in FIG. 4, the potential Vb of the developing sleeve 46 is shown advanced approximately by the time interval (t1–t2) in order to more clearly compare the potentials.

At a time t3, the control board 90*a* stops supplying the voltage to the transfer roller 42 while keeping the erase lamp 45 illuminated. The laser beam 81*c* is emitted by the laser source 81*a* until the potential is erased from the entire surface of the photosensitive drum 41. Thereafter, the rotation of the photosensitive drum 41 is stopped, as are the laser beam emission and erase lamp illumination to complete the postprocessing.

Figure 6:
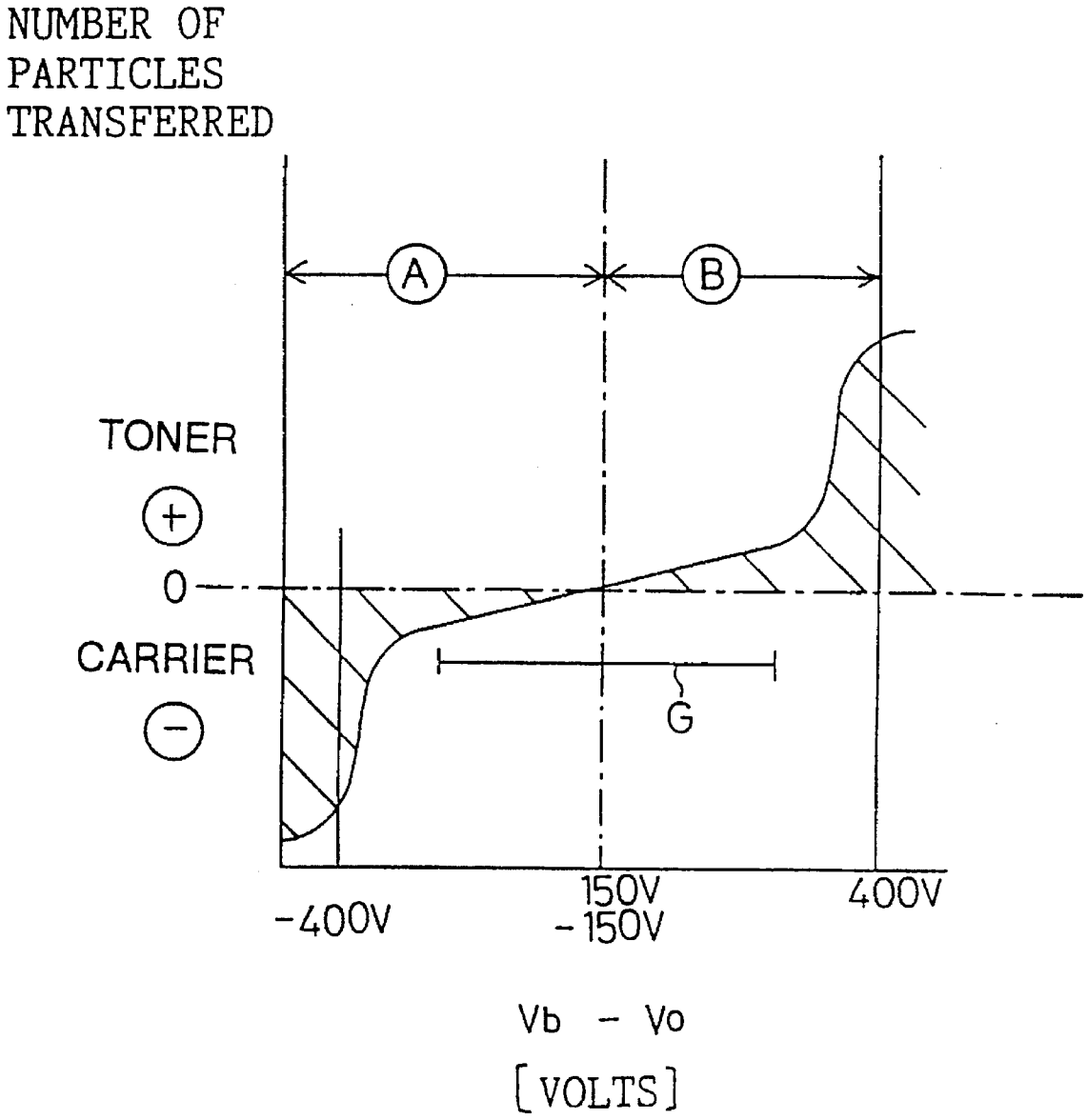
FIG. 6 is a graphical representation of the relationship between the potential difference between the photosensitive drum and the developing sleeve, and the sticking behavior of the toner and carrier in the first preferred embodiment.

In FIG. 6, the abscissa represents the potential difference between the developing sleeve potential Vb and the photosensitive drum potential Vo, i.e. Vb–Vo. It should be noted that the range of potential differences from 150 V to −150 V is omitted of the middle of the graph shown in FIG. 6 of abscissa. As the potential difference approaches 400 V, the positively charged toner particles begin sticking to the photosensitive drum 41. Conversely, as the potential difference approaches −400 V, the negatively charged carriers become liable to stick to the photosensitive drum 41. Within the range of potential difference indicated by range G in FIG. 6, the toner and carrier are least likely to stick to the photosensitive drum 41. These potential differences are such that some of the toner particles and carriers attach to the photosensitive drum 41 but the quantities are practically negligible.

With the conventional image forming apparatus described above in reference to FIG. 13, the laser beam lowers the surface potential of the photosensitive drum 41 down to 150 V in binary fashion. Thus, a timing error, such as indicated by reference characters a or b in FIG. 13 leaves a huge, momentarily developing potential difference with respect to the fairly rapid potential drop of the developing sleeve 146. This causes the toner particles or carriers to stick to the photosensitive drum 41. In contrast, in the first preferred embodiment, the potential of the photosensitive drum 41 drops in two steps, as shown in FIG. 4. This allows the potential difference between the photosensitive drum 41 and the developing sleeve 46 to fall within the tolerable range G shown in FIG. 6. As a result, the toner particles and the carriers are prevented from sticking to the photosensitive drum 41.

Manufacturing errors make it difficult to keep constant the distance between the laser beam-irradiated position on the photosensitive drum 41, indicated by point D in FIG. 2, and the position of contact between the photosensitive drum 41 and the developing sleeve 46, indicated by point E, constant. Thus, even if the potential Vb of the developing sleeve 46 is lowered immediately after the time t2 in FIG. 3, so that curve c in FIG. 4 is targeted, it often happens in the conventional image forming apparatus that the potential of the developing sleeve 46 is deactivated after the laser beam-irradiated position has arrived (timing delayed), as indicated by curve b in FIG. 4, or before (timing advanced), as indicated by curve a in FIG. 4. However, in the first preferred embodiment of this invention, the potential of the photosensitive drum 41 drops in two steps, as shown in FIG. 4. This makes it possible, regardless of minor timing errors indicated by the curves a and b, to keep the potential difference between the photosensitive drum 41 and the developing sleeve 46 small enough to suppress the undesirable sticking of the toner or the carriers.

Figure 5:
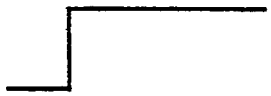
FIGS. 5(A), 5(B), 5(C), and 5(D) are waveform charts showing modulated waveforms of the laser source in the first preferred embodiment.
Figure 5:
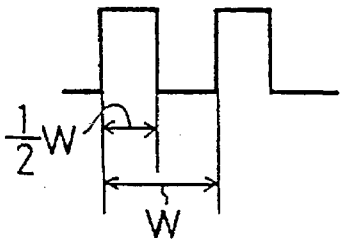
Figure 5:
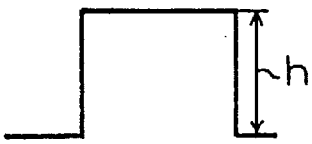
Figure 5:
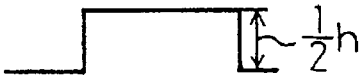

Another way to reduce the output of the laser source 81*b* will now be described with reference to FIGS. 5 (A) through 5 (D). In the setup described above, the effects of the laser beam 81*c* output by the laser source 81*a* was adjusted by varying the output duty ratio, as illustrated in FIGS. 5(A) and 5(B). Alternatively, as shown in FIGS. 5(C) and 5(D), the effects of the laser output by the laser source 81*a* may be regulated by changing its peak value, i.e., the intensity of the laser beam 81*c*. The waveform shown in FIG. 5(C) is a 100% intensity beam output and that shown in FIG. 5(D) is a 50% intensity beam output.

Figure 7:
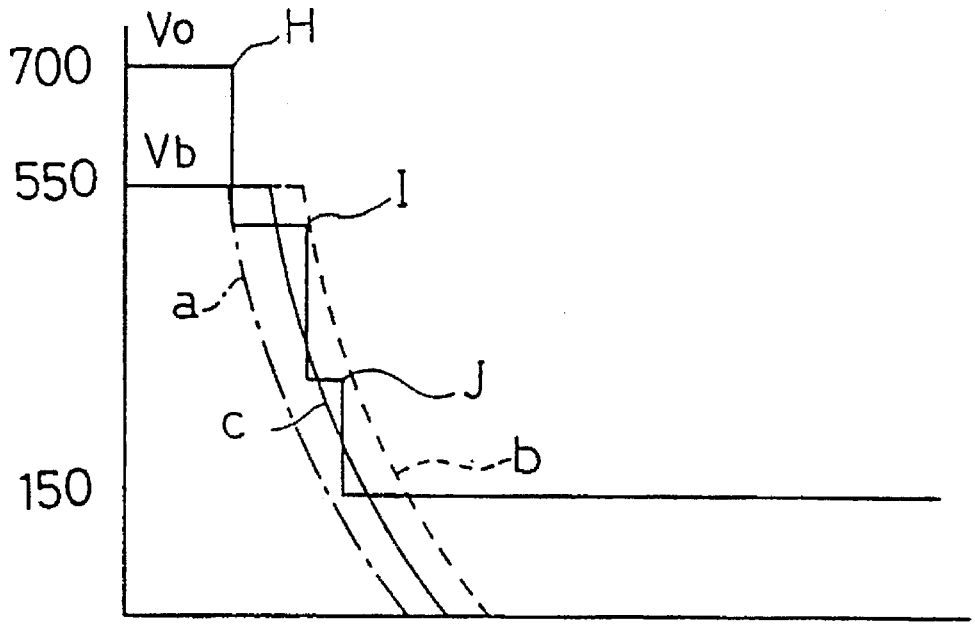
FIG. 7 is a graphical representation of the potentials applied to the photosensitive drum and developing sleeve in a variation of the first preferred embodiment.

A variation of the first preferred embodiment is shown in FIG. 7. Whereas the laser beam intensity was changed in two steps in the first preferred embodiment shown in FIG. 4, in FIG. 7 the laser beam intensity is changed in three steps.

Specifically, the laser beam 81*c* is initially emitted at a 33% beam intensity level, as indicated by point H. The emission intensity of the laser beam 81*c* is then raised to 66%, as indicated by point I. Eventually, the emission intensity of the laser beam 81*c* is raised to 100%, at which the surface charges of the photosensitive drum 41 are fully erased, as indicated by point J. By permitting a smoother adjustment of the surface potential of the photosensitive drum 41, the embodiment shown in FIG. 7 further reduces the potential difference between the photosensitive drum 41 and the developing sleeve 46 when the developing sleeve 46 is switched off. In FIG. 7, as in FIG. 4, the potential Vb of the developing sleeve 46 is also shown advanced approximately by the time interval (t1–t2), in order to expedite the comparison of the potentials.

Figure 8:
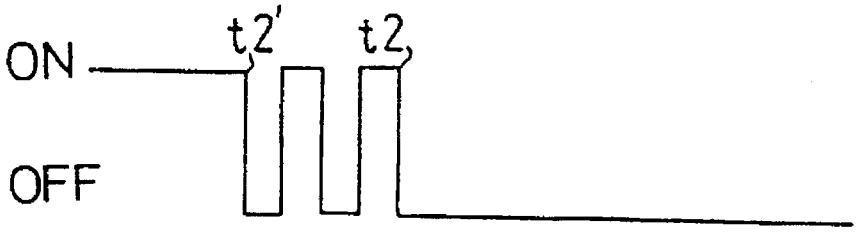
FIG. 8 is a waveform chart showing how the switch circuit of the developing sleeve is turned on and off in a second preferred embodiment of the image forming apparatus of this invention.
Figure 9:
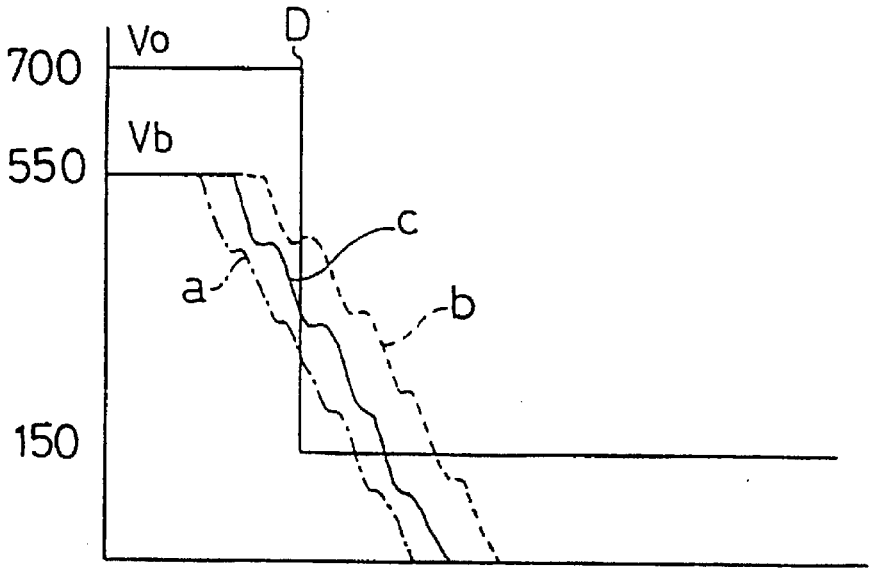
FIG. 9 is a graphical representation of the potentials applied to the photosensitive drum and developing sleeve of the second preferred embodiment.

A second preferred embodiment of this invention is shown in FIG. 8. The circuits and the potential timing of the second preferred embodiment are approximately the same as those of the above-described first preferred embodiment. Thus FIGS. 2 and 3(A) through 3(D) also describe the second preferred embodiment. FIG. 8 shows how the switch circuit 116 is controlled in the second preferred embodiment. FIG. 9 is a graphical representation of the potentials applied to the photosensitive drum 41 and developing sleeve 46 in the second preferred embodiment. In FIG. 9, as in FIG. 4, the potential Vb of the developing sleeve 46 is also shown advanced approximately by the time interval (t1–t2) in order to expedite the comparison of the potentials.

At the start of postprocessing in the second preferred embodiment, the control board 90*b* controls the laser source 81*b* to initially continuously emit the laser beam 81*c* at a duty ratio of 100% from time t1. In that portion of the photosensitive drum 41 which was initiated by the laser beam 81*c*, as indicated by point D in FIG. 9, the surface potential drops to about 150 V.

Meanwhile, based on the clock signal from the timer 96, the control board 90*a* intermittently turns on and off the switch circuit 116, as shown in FIG. 8, slightly before the portion on the photosensitive drum 41, which was irradiated by the laser beam 81*c* at the time t1, as indicated by point D in FIG. 2, reaches the developing sleeve 46 at time t2', as shown in FIG. 3(C). The switch circuit 116 is turned on and off in such a way that the potential Vb of the developing sleeve 46, differentiated by the capacitor 117, gradually drops (illustratively) along the curve c in FIG. 9. Past the time t2, the switch circuit 116 is permanently turned off to reduce the potential of the developing sleeve 46 to ground, as shown in FIG. 9.

Figure 13:
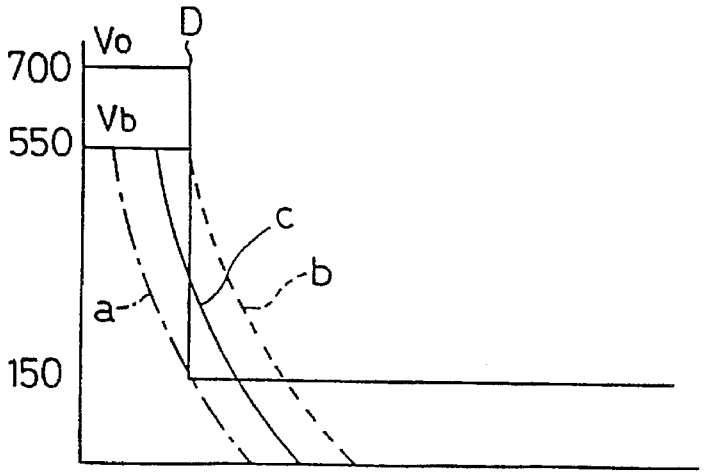
Fig.13 PRIOR ART
FIG. 13 is a graphical representation of the potentials applied to the photosensitive drum and developing sleeve in a typical conventional image forming apparatus.

With the conventional image forming apparatus shown in FIG. 13, the potential of the developing sleeve 46 takes an integral waveform due to the presence of the capacitor 117, but still manifests a fairly rapid drop. In contrast, in the second preferred embodiment of this invention, the potential Vo of the developing sleeve 46 drops gradually, as illustrated in FIG. 9. Thus, the potential difference between the photosensitive drum 41 and the developing sleeve 46 does not grow appreciably whether the developing sleeve potential is deactivated after the laser beam-irradiated position of the photosensitive drum has arrived (timing delayed), as shown by curve b in FIG. 9, or before the laser beam-irradiated position arrives (timing advanced), as shown by curve a in FIG. 9. In this manner, the toner particles or carriers are prevented from sticking to the photosensitive drum 41.

Figure 10:
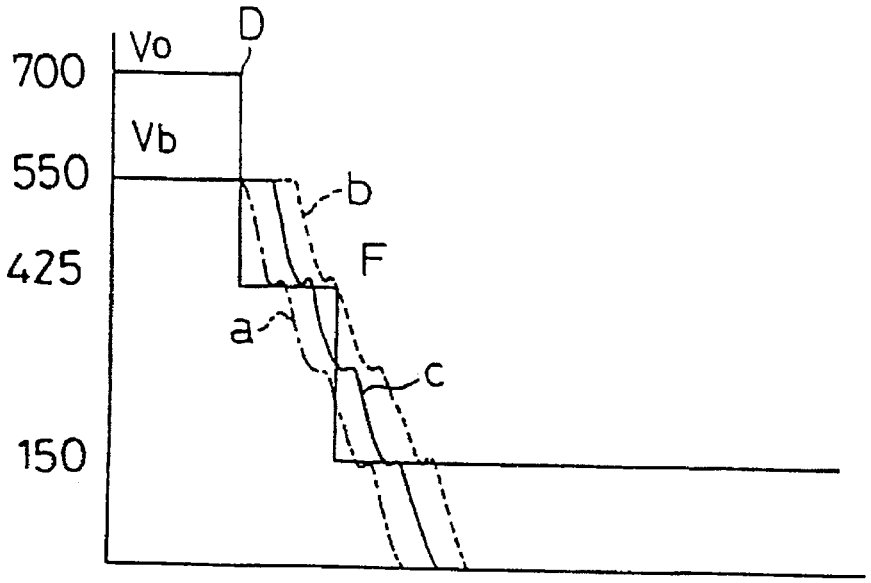
FIG. 10 is a graphical representation of the potentials applied to the photosensitive drum and developing sleeve of a third preferred embodiment of the image forming apparatus of this invention.
Figure 11:
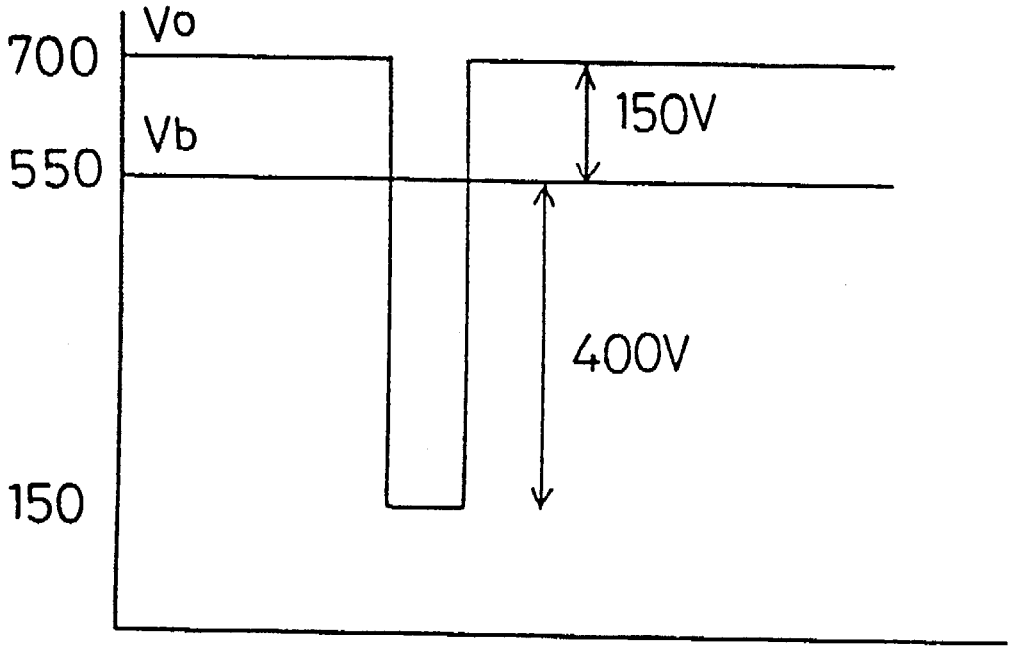
Fig.11 PRIOR ART
FIG. 11 is a graphical representation of the photosensitive drum potential and the developing sleeve potential of a conventional reversal development method-type image forming apparatus.
Figure 12:
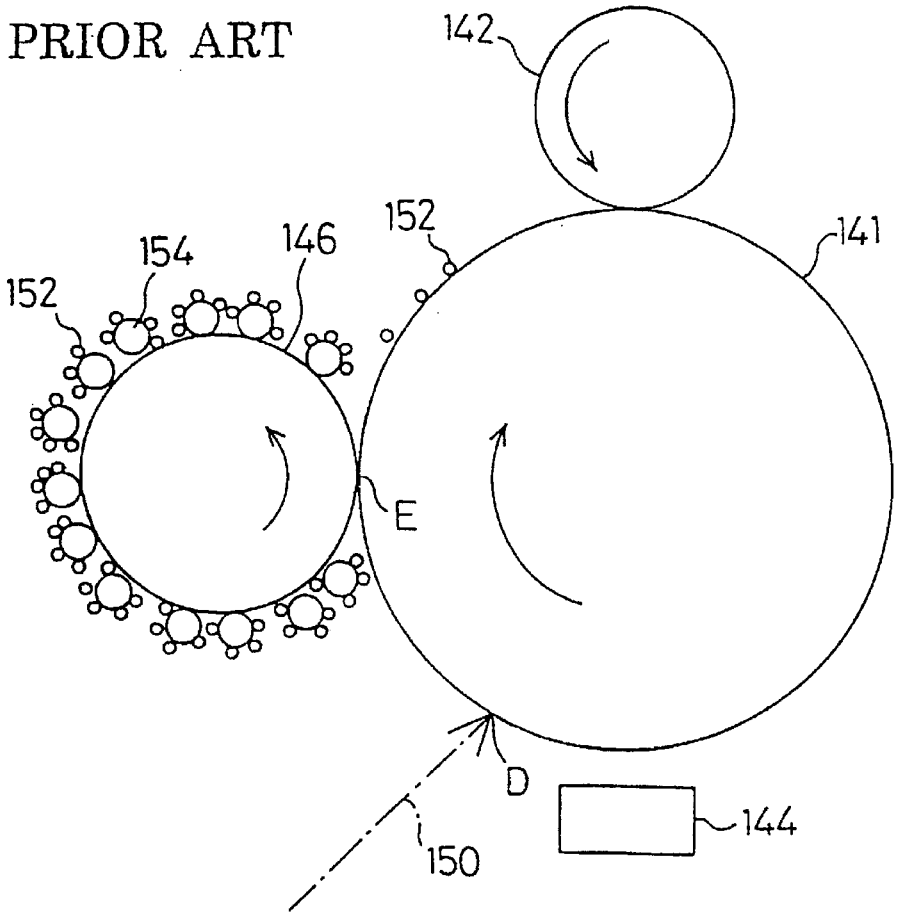
Fig.12 PRIOR ART
FIG. 12 is a schematic view of a typical conventional photosensitive drum.

A third preferred embodiment of the invention is shown in FIG. 10. The circuits and the potential timing of the third preferred embodiment are approximately the same as those of the above-described first and second preferred embodiments. Thus FIGS. 2 and 3 (A) through 3 (D) also describe the third preferred embodiment. FIG. 10 is a graphical representation of the potentials applied to the photosensitive drum 41 and developing sleeve 46 in the third preferred embodiment. In FIG. 10, as in FIG. 4, the potential Vb of the developing sleeve 46 is also shown advanced approximately by the time interval (t1–t2) in order to expedite the comparison of the potentials.

Figure 3:
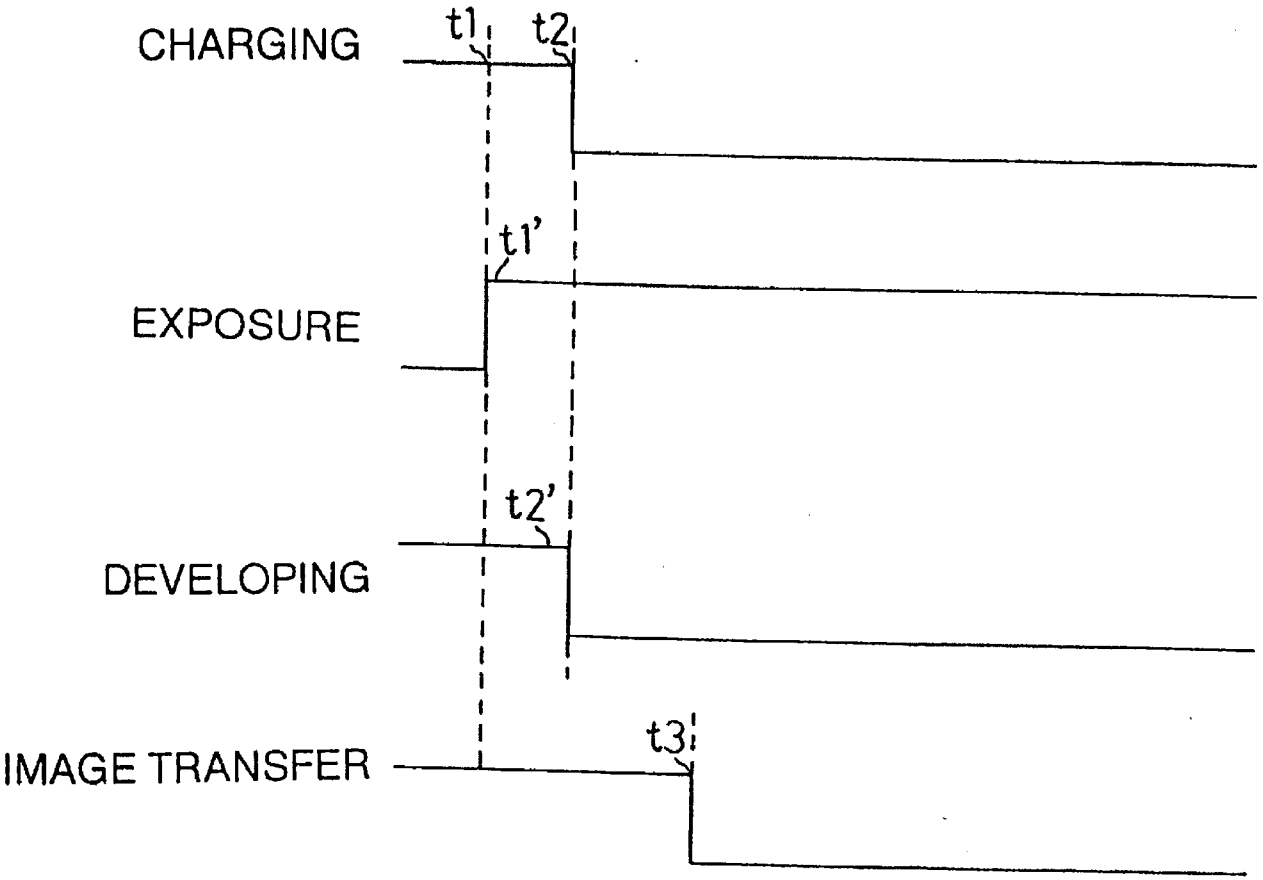
FIGS. 3(A), 3(B), 3(C), and 3(D) are timing charts for potentials applied in different operations.
Figure 4:
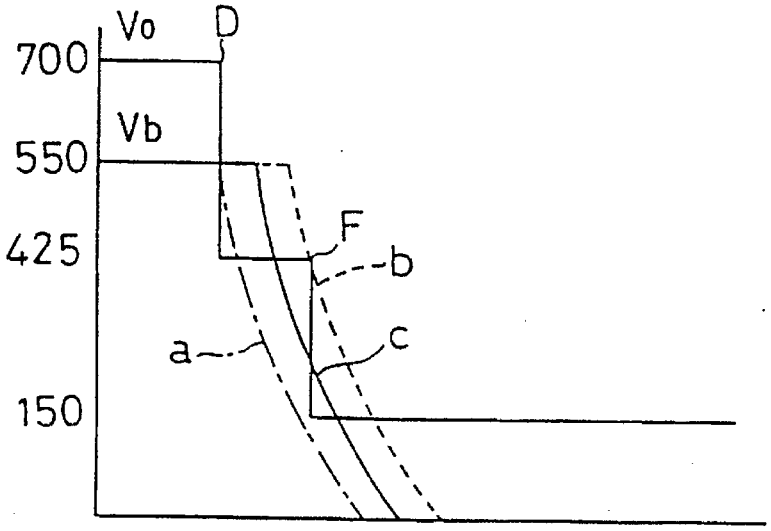
FIG. 4 is a graphical representation of the potentials applied to the photosensitive drum and developing sleeve in the first preferred embodiment.

At the time t1, at which the image forming apparatus of FIG. 3 starts its postprocessing, the control board 90*b* controls the laser source 81*b* to start emitting the laser beam 81*c*. At this point, the control board 90*b* supplies the laser source 81*b* with a pulse modulation signal having a 50% duty ratio, as shown in FIG. 5(B). In that portion of the photosensitive drum 41 which is indicated by the laser beam 81*c*, the surface potential drops to about 425 V as indicated by point D in FIG. 10. The control board 90*b* controls the laser source 81*b* to maintain the 50% duty ratio of the laser beam 81*c* until time t1' is reached. From the time t1' on, the control board 90*b* outputs a pulse modulation signal having a 100% duty ratio to the laser source 81*b*, as shown in FIG. 5(A). This results in continuous laser beam 81*c* being emitted. In that portion of the photosensitive drum 41 which is irradiated by this continuous laser beam 81*c*, the surface potential drops to about 150 V, as indicated by point F in FIG. 10.

Meanwhile, as in the second preferred embodiment, and based on the clock signal from the timer 96, the control board 90*a* intermittently turns on and off the switch circuit 116, as shown in FIG. 8, and slightly before that portion of the photosensitive drum 41 which was irradiated by the laser beam 91*c* emitted at time t1, as indicated by point D in FIG. 2, reaches the developing sleeve 46 at time t2', as shown in FIG. 3(C). The switch circuit 116 is turned on and off in such a way that the potential of the developing sleeve 46 gradually drops (illustratively) along the curve c in FIG. 10. Past the time t2, as shown in FIG. 3(C), the switch circuit 116 is permanently turned off to decrease the potential of the developing sleeve 46 completely to ground.

The third preferred embodiment of the invention thus causes the potential Vo of the photosensitive drum 41 to drop in two steps, while gradually lowering the potential Vb of the developing sleeve 46, as illustrated in FIG. 10. The potential difference between the photosensitive drum 41 and the developing sleeve 46 thus falls within the range G of FIG. 6, with the result that the toner particles or the carriers are kept from sticking to the photosensitive drum 41. In addition, the potential difference between the photosensitive drum 41 and the developing sleeve 46 does not grow large enough to cause undesirable sticking of the toner particles or the carriers, whether the developing sleeve potential is deactivated after the laser beam-irradiated position of the photosensitive drum has arrived (timing delayed), as indicated by curve b in FIG. 10), or before the laser beam-irradiated position arrives (timing advanced) as indicated by curve a in FIG. 10.

Although the above description of the first through the third preferred embodiments of this invention set forth some specific values regarding the sticking behavior of the toner particles and the carriers, as discussed in reference to FIG. 6, these values may be replaced by other appropriate values depending on the quality and other parameters of the toner particles and carriers used. Given the specific characteristics of the toner particles and the carriers used in the image forming apparatus, those skilled in the art will be able to select, among others, optimum timing values for deactivating the potential on the developing sleeve 46.

While this invention has been described in conjunction with the specific embodiments outline above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image forming apparatus, comprising:

a photosensitive drum, having a surface;

a charger for electrically charging the surface of said photosensitive drum;

a laser unit for emitting a laser beam to discharge the surface of said photosensitive drum to form a latent image on the surface;

a developing sleeve for developing the latent image formed on the surface of said photosensitive drum;

a developing sleeve power supply for charging said developing sleeve; and a control unit for controlling said laser unit and said developing sleeve power supply;

wherein, when the image forming apparatus is stopped, said control unit controls said laser unit to emit a reduced output laser beam, and, after a predetermined time, to emit a full output laser beam to expose the surface of said photosensitive drum with the laser beam to begin discharging the surface; and wherein said control unit deactivates said developing sleeve power supply when a leading portion of said photosensitive drum discharged by the reduced output laser beam reaches said developing sleeve.

2. The image forming apparatus of claim 1, wherein said control unit pulse width-modulates said laser unit to emit the reduced output laser beam.

3. The image forming apparatus of claim 1, wherein said developing sleeve power supply comprises:

a first switch for controlling power to the charger and a step-down circuit; and a second switch for controlling power from the step-down circuit to said developing sleeve;

wherein, when said first switch is open, power to said charger and said developing sleeve is cut off, when said first switch and said second switch are closed, power is connected to said charger and said developing sleeve, and when said first switch is closed and said second switch is open, power is connected to said charger and power is cut off to said developing sleeve.

4. The image forming apparatus of claim 1, wherein said control unit comprises a timer circuit for counting said predetermined time after said control unit begins to control said laser unit to emit the reduced output laser beam.

5. The image forming apparatus of claim 4, wherein rotation of said photosensitive drum is synchronized with an operation of said timer circuit.

6. The image forming apparatus of claim 1, wherein, during said predetermined time, said control unit controls said laser unit to emit, in sequence, each of a plurality of reduced output laser beams for a corresponding predetermined time, each reduced output laser beam being reduced less than preceding ones of the plurality of reduced output laser beams.

7. The image forming apparatus of claim 6, wherein, during said predetermined time, said control unit controls said laser unit to emit in succession a first reduced output laser beam during a first portion of said predetermined time and a second reduced output laser beam during a second portion of said predetermined time, the first reduced output laser beam being reduced more than the second reduced output laser beam.

8. The image forming apparatus of claim 7, wherein the first reduced output laser beam is emitted at 33% of the full output laser beam and the second reduced output laser beam is emitted at 66% of the full output laser beam.

9. The image forming apparatus of claim 1, wherein said control unit controls said laser unit to lower an intensity of the laser beam to emit the reduced output laser beam.

10. An image forming apparatus, comprising:

a photosensitive drum, having a surface;

a charger for electrically charging the surface of said photosensitive drum;

a laser unit for emitting a laser beam to discharge the surface of said photosensitive drum to form a latent image on the surface;

a developing sleeve for developing the latent image formed on the surface of said photosensitive drum;

a developing sleeve power supply for charging said developing sleeve; and a control unit for controlling said laser unit and said developing sleeve power supply;

wherein, when the image forming apparatus is stopped, said control unit controls said developing sleeve power supply to intermittently cut off a supply of power to said developing sleeve and, after a predetermined time, to permanently cut off the supply of power to said developing sleeve, and said control unit controls said laser unit to emit a laser beam to expose the surface of said photosensitive drum with the laser beam to begin discharging the surface; and wherein said control unit permanently cuts off said developing sleeve power supply when a leading portion of said photosensitive drum discharged by the laser beam reaches said developing sleeve.

11. The image forming apparatus of claim 10, wherein the developing sleeve power supply comprises:

a first switch for controlling power to the charger; and a second switch for controlling power from the first switch to said developing sleeve;

wherein, when said first switch is open, power to said charger and said developing sleeve is cut off, when said first switch and said second switch are closed, power is provided to said charger and said developing sleeve, and when said first switch is closed and said second switch is open, power is provided to said charger and power is cut off to said developing sleeve.

12. The image forming apparatus of claim 10, wherein:

said control unit comprises a timer circuit for counting said predetermined time after said control unit begins to control said developing sleeve power supply to intermittently cut off the supply of power to said developing sleeve, and rotation of said photosensitive drum is synchronized with an operation of said timer circuit.

13. An image forming apparatus, comprising:

a photosensitive drum, having a surface;

a charger for electrically charging the surface of said photosensitive drum;

a laser unit for emitting a laser beam to discharge the surface of said photosensitive drum to form a latent image on the surface;

a developing sleeve for developing the latent image formed on the surface of said photosensitive drum;

a developing sleeve power supply for charging said developing sleeve; and a control unit for controlling said laser unit and said developing sleeve power supply;

wherein, when the image forming apparatus is stopped, said control unit controls said laser unit to emit a reduced output laser beam to discharge the surface, and, after a first predetermined time, to emit a full output laser beam to expose the surface of said photosensitive drum with the laser beam to discharge the surface, and said control unit further controls said developing sleeve power supply to intermittently cut off a supply of power to said developing sleeve, and, after a second predetermined time, to permanently cut off the supply of power to said developing sleeve; and wherein said control unit permanently cuts off said developing sleeve power supply when a leading portion of said photosensitive drum discharged by the reduced output laser beam reaches said developing sleeve.

14. The image forming apparatus of claim 13, wherein said control unit pulse width modulates said laser unit to emit the reduced output laser beam.

15. The image forming apparatus of claim 13, wherein said control unit controls said laser unit to lower an intensity of the laser beam to emit the reduced output laser beam.

16. The image forming apparatus of claim 13, wherein said control unit controls said laser unit to emit the reduced output laser beam to discharge the surface at a first time, said developing sleeve power supply to intermittently cut off the supply of power to said developing sleeve at a second time after the first time, said laser unit to emit the full output laser beam at a third time after the second time, and said developing sleeve power supply to permanently cut off the supply of power to said developing sleeve at a fourth time after the third time.

17. The image forming apparatus of claim 16, wherein said developing sleeve power supply comprises:

a first switch for controlling power to the charger; and a second switch for controlling power from the first switch to said developing sleeve;

wherein, when said first switch is open, power to said charger and said developing sleeve is cut off, when said first switch and said second switch are closed, power is provided to said charger and said developing sleeve, and when said first switch is closed and said second switch is open, power is provided to said charger and power is cut off to said developing sleeve.

18. The image forming apparatus of claim 17, wherein:

said control unit comprises a timer circuit for counting said first predetermined time after said control unit begins to control said laser unit to emit the reduced output laser beam and for counting said second predetermined time after said control unit begins to control said developing sleeve power supply to intermittently cut off power to said developing sleeve, and rotation of said photosensitive drum is synchronized with an operation of said timer circuit.

19. The image forming apparatus of claim 13, wherein said control unit controls said laser unit to emit the reduced output laser beam to discharge the surface at a first time, said laser unit to emit the full output laser beam at a second time after the first time, said developing sleeve power supply to intermittently cut off the supply of power to said developing sleeve at a third time after the second time, and said developing sleeve power supply to permanently cut off the supply of power to said developing sleeve at a fourth time after the third time.

20. The image forming apparatus of claim 19, wherein said developing sleeve power supply comprises:

a first switch for controlling power to the charger; and a second switch for controlling power from the first switch to said developing sleeve;

wherein, when said first switch is open, power to said charger and said developing sleeve is cut off, when said first switch and said second switch are closed, power is provided to said charger and said developing sleeve, and when said first switch is closed and said second switch is open, power is provided to said charger and power is cut off to said developing sleeve.

* * * * *